US007559445B1

(12) United States Patent
Kulp

(10) Patent No.: US 7,559,445 B1
(45) Date of Patent: Jul. 14, 2009

(54) PAINTBALL POD CARRIER

(76) Inventor: Donald Lee Kulp, 2 Karen Ct., Lititz, PA (US) 17543

( * ) Notice: Subject to any disclaimer, the term of this patent is extended or adjusted under 35 U.S.C. 154(b) by 547 days.

(21) Appl. No.: 11/311,034

(22) Filed: Dec. 17, 2005

(51) Int. Cl.
*A45C 1/01* (2006.10)

(52) U.S. Cl. ..... 224/627; 224/673; 224/674; 224/682; 224/684

(58) Field of Classification Search ..... 224/627, 224/673, 674, 682, 684, 931, 196
See application file for complete search history.

(56) References Cited

U.S. PATENT DOCUMENTS 5,470,001 A * 11/1995 Konchan ..... 224/673
5,477,998 A * 12/1995 Reckler ..... 224/586
6,158,642 A 12/2000 Herbage
6,327,953 B1 12/2001 Andresen
6,718,558 B1 4/2004 Callanta
6,843,399 B2 1/2005 Garcia
6,962,278 B2 * 11/2005 Obatake ..... 224/681
7,100,810 B1 * 9/2006 Bosch et al. ..... 224/682
2004/0144823 A1 7/2004 Obatake
2004/0222258 A1 * 11/2004 Ho et al. ..... 224/191

* cited by examiner

*Primary Examiner*—Nathan J Newhouse
*Assistant Examiner*—Lester L Vanterpool
(74) *Attorney, Agent, or Firm*—Andrew D. Mead

(57) ABSTRACT

The invention is a user-wearable caddy for carrying and dispensing a number of paintball supply tubes, known as pods, designed to be worn on the back of a paintball game participant. The invention carries multiple pods in a horizontal orientation on the wearer's back using elastic bands to grip the pods yet allow them to be removed from the pack. Vertically oriented guides enable elastic loops securing the pods to the pack to move vertically. As the player removes the lowermost pod from the pack, the pods above will descend along the guides, by the influence of gravity and by tension from an elastic band stretched from the top-most elastic loop to the bottom of the caddy structure, so that the next full pod will be positioned in approximately the same location as the previous pod. The invention enables the player to reach around to the same location each time to obtain a full pod, reducing the time needed to reload the paintball marker.

7 Claims, 6 Drawing Sheets

PAINTBALL POD CARRIER

BACKGROUND OF THE INVENTION

1. Field of the Invention

This invention relates generally to tool belts and fabric caddies useful for carrying items. In particular, this invention relates to user-wearable apparatus used to carry additional supplies of paintballs while playing paintball war games.

2. Description of the Prior Art

The sport of paintball war games continues to grow in popularity. During these war games, participants shoot frangible plastic balls full of a liquid dye at their opponents. Participants are excluded from further play once they have been hit and marked by a paintball. The games are sometimes intensely competitive, requiring a participant to aim a gun, also known as a marker, at an opponent while pursuing, fleeing, dodging, or running for cover. During the game, a participant might discharge between several hundred and one thousand or more paintballs. Because a typical marker storage hopper has a finite paintball storage capacity, generally ranging from 200 to 250, the participant must reload the marker several times during game play. This is done by pouring painitballs from a cylindrical reloading container, known as a "pod," into the marker hopper. The pod has a snap-closed cap at one end and contains between 100 and 150 paintballs. The pods must be carries by the player to enable rapid reloading of the marker. Due to the large number of paintballs expended during a typical game, the player must carry several paintball pods during the game. The prior art has provided several types of paintball container carrying belts. The most common example of carrier has a series of pockets formed against the outside surface of the belt. Each pocket can securely nest one paintball container. A paintball player's belt may also be encumbered and burdened by other articles hanging from it or secured to it, such as replacement goggles, flashlight, radio communication device, pouches of cleaning wipes and other miscellany, to a point where only a very small number of paintball pods can be accommodated.

In tournament competition, game duration is on the order of a few minutes. Players are vulnerable while reloading their marker, so it is highly desirable for the marker reloading to be accomplished in the least amount of time possible. Numerous carriers exist to fill this need. U.S. Pat. No. 6,327,953 by Andresen discloses a large paintball container combined with an automatic feed apparatus capable of delivering paintballs directly from the bulk storage container to the paintball marker's firing chamber. Since Andresen's storage hopper is worn by the player instead of mounted directly on the marker, the size of the storage hopper may be increased to suit the needs of specific paintball games. Having a larger stored volume of paintballs eliminates the need to carry additional storage pods. Andresen is disadvantaged by having a relatively long feed tube extending from the loader drive mechanism to the marker's firing chamber that can lead to jamming. A jam in the feeding mechanism effectively eliminates the player from the game and is therefore highly undesirable. The size of the combined storage hopper and automatic feed apparatus also makes the Andresen invention bulky and could inhibit the player's movement.

Several variations of an ammunition belt are known, each based on the paintball storage pods common in the sport. U.S. Pat. No. 6,158,642 by Herbage discloses a modular carrier assembly that includes a belt and a readily detachable pack capable of storing paintball pods. The pack fasteners allow the pack to be quickly removed so that paintball pods can be easily accessed without requiring the wearer to reach around to the pack location. The Herbage carrier requires that the player first remove the pack then remove a paintball pod to refill the hopper on the paintball marker. Replacing the pack following the reloading procedure requires an extra, time-consuming step. Additionally, since the pack is located on the player's back, the player must reach around to his/her back in order to reattach the pack.

U.S. Pat. No. 6,718,558 by Callanta discloses a paintball pod carrying belt having multiple elastic loops that secure multiple paintball pods in a vertical orientation along the wearer's back. Each loop includes a flap for the bottom that allows the bottom of the loop to be closed to prevent pods from slipping out. The flaps are secured to the belt on one end and to the loop with a hook and loop fastener on the other end. Opening the flap allows the pod to be removed. Locations of the loops on the Callanta belt are fixed. The player is forced to reach further around his/her back to reach pods held in the center loops than those held in the peripheral loops. Additionally, a player is forced to reach around to the opposite side of his/her back in the event that player chooses to use the same hand to remove all pod to avoid having to release or change grip on the paintball marker.

U.S. Pat. No. 6,843,399 by Garcia discloses a belt caddy for carrying a paintball pods using a combination of elastic and hook and loop fasteners. An elastic band encircles each paintball pod. The outer circumference of the bands are covered in near-equal proportions by the first and second sides of hook and loop fastener material. The belt includes a pair of cooperating straps that are lined with the first and second sides of the hook and loop fastener material. The straps then encircle the pods and hold them in place by virtue of the hook and loop fasteners. The pods may be individually removed by sliding them out of their elastic bands. The Garcia disclosure allows a variable number of pods to be carried depending on the needs of the particular paintball game. However, as with the Callanta disclosure, the player is forced to reach around to his/her back and locate a loop containing a pod. As more pods are removed, more time is needed to locate a pod.

The present invention improves upon the limitations of the known art by providing a paintball pod carrier that places a full pod in the same relative position each time the player reaches for a pod. It also places the pods such that the player is not required to reach around to the central region of his/her back in order to grasp the paintball pod. These improvements decrease the time required for a paintball game player to refill the paintball marker hopper thereby enhancing the competitiveness of the paintball game player.

SUMMARY OF THE INVENTION

The present invention is a user-wearable caddy for carrying and dispensing a number of paintball pods designed to be worn on the back of a paintball game participant. The invention carries multiple pods in a horizontal orientation on the player's back using elastic loops to grip the pods. The pods may be removed by sliding them from the from the loops. A frame affixed to a belt worn around the player's waist provides support for the stored pods. Larger frames capable of carrying more paintball pods are feasible if the frame is connected to the player's body using straps similar to a backpack and are envisioned. Vertically oriented guides formed in the frame enable the elastic loops securing the pods to the pack to move vertically with respect to the player. As the lower-most pod is removed from the pack, the pods above will descend along the guides, by the influence of gravity and by tension from an elastic band stretched from the top-most elastic loop to the bottom of the frame, so that the next full pod will be positioned in approximately the same location as the previous pod, that is near the bottom edge of the frame. This enables the player to reach around to the same location each time to obtain a full pod instead of grasping along the span of pod containers to find one containing a pod, thereby reducing the time needed to reload the paintball marker. Additionally, the horizontal orientation of the pods in the carrier position the ends of the pods closer to the player's side thereby reducing the reach needed to grasp a pod when compared to caddies that place the pods more centrally on the backside of the player's waist.

DETAILED DESCRIPTION OF THE INVENTION

When referring to the Figures, like parts are numbered the same in all of the Figures.

Figure 1:
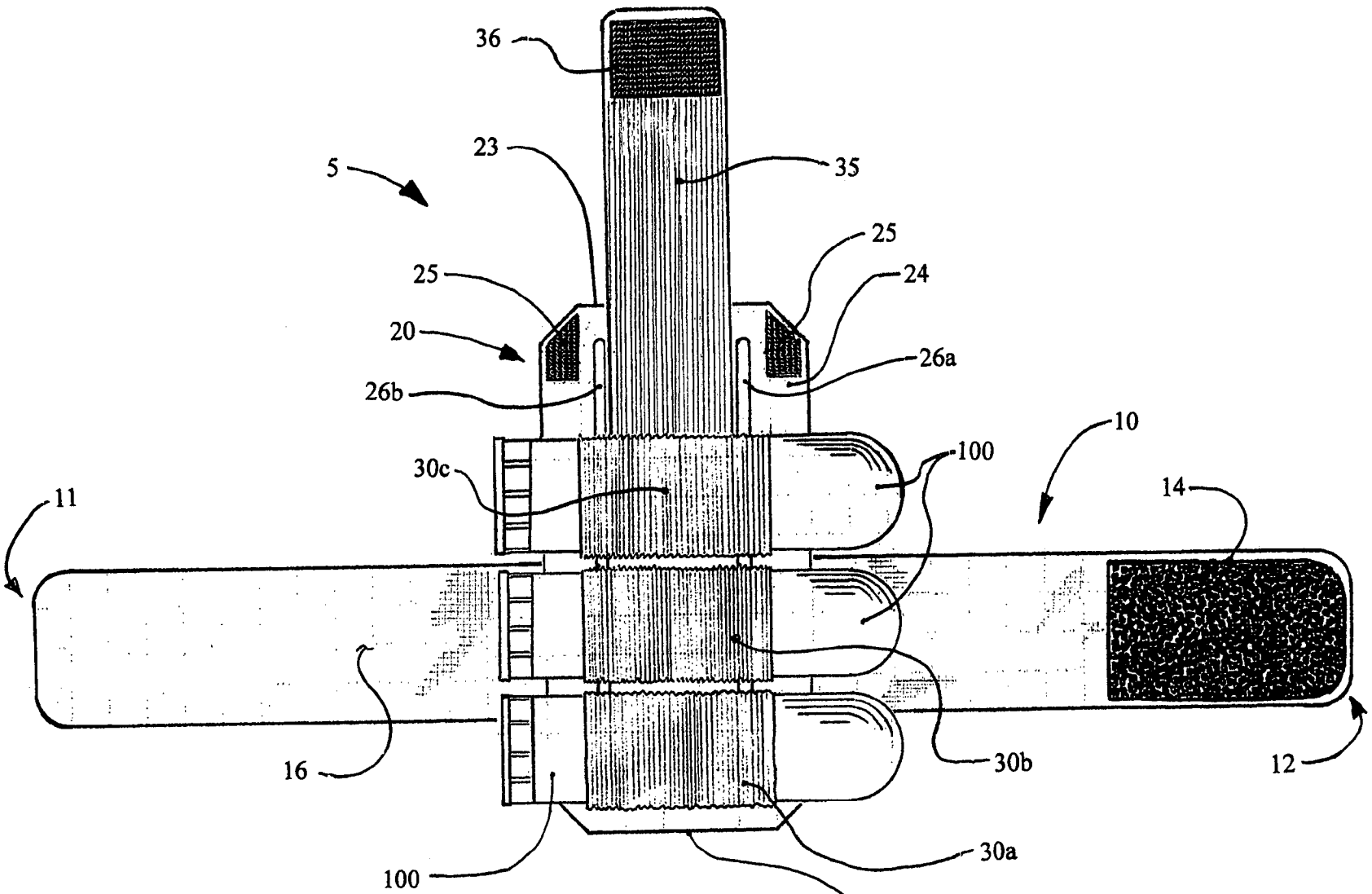
FIG. 1 is an elevation view of the paintball pod carrier using a belt to attach the carrier to the player's body viewed from the player's back with paintball pods in place.
Figure 2:
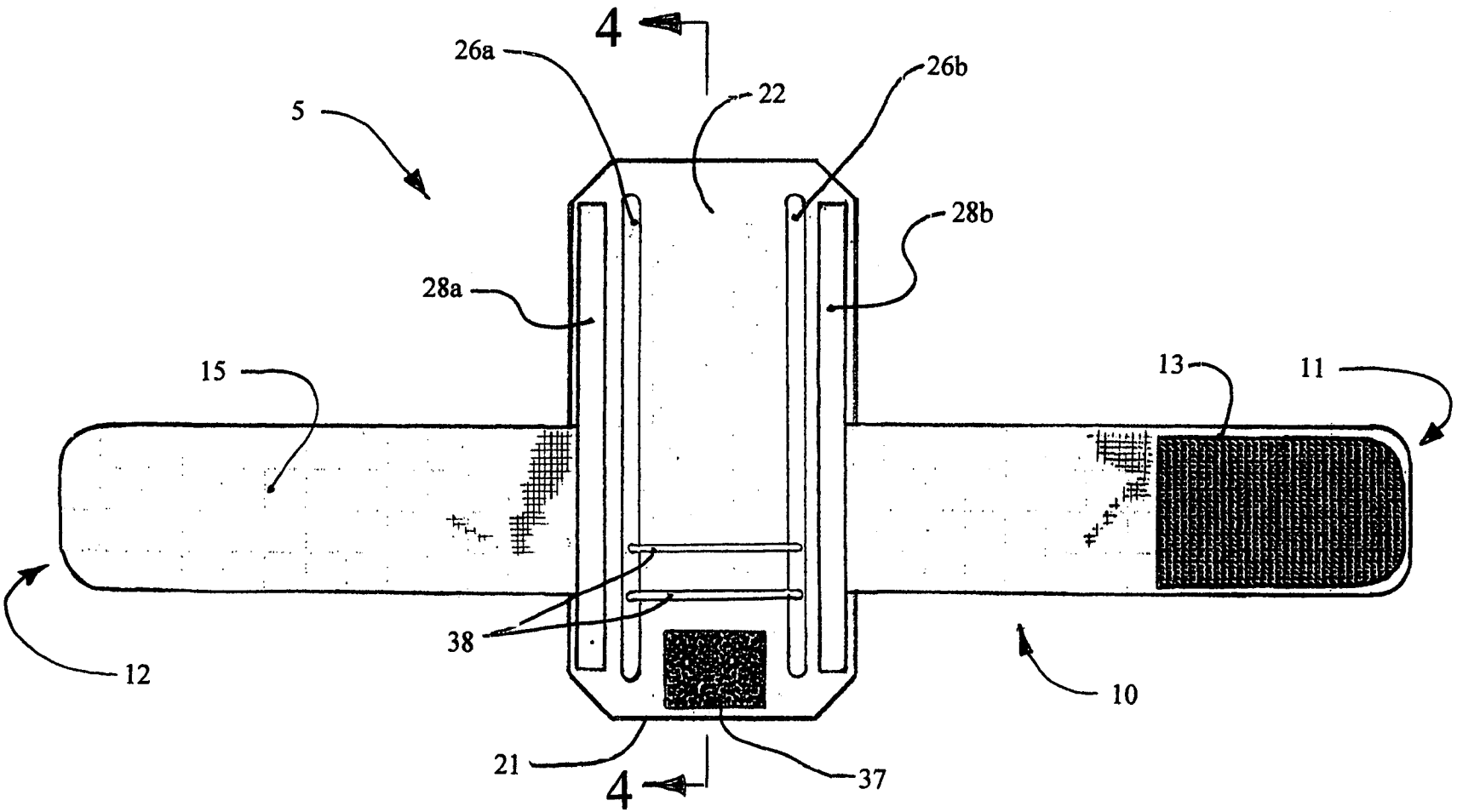
FIG. 2 is an elevation view of the paintball pod carrier using a belt to attach the carrier to the player's body viewed from the player's front.

FIG. 1 shows the paintball pod carrier 5 using a belt 10 to attach the carrier to the player's body. Shown is outward surface 16 of belt 10 which has a first end 11 and a second end 12. Belt 10 is designed to be worn around a player's waist during paintball game play. In the preferred embodiment, belt 10 is made from a durable fabric material, such as canvas or cordura nylon, though any pliable material is suitable. The first end 11 and the second end 12 are secured around the player's waist by any suitable means. In the preferred embodiment, a one side of a hook and loop fastener material is affixed to the inward surface of one end of the belt and the mating side of the hook and loop fastener material is affixed to the outward surface of the other end of the belt so that the hook and loop material will mesh when the belt ends are brought together thereby securing the belt. The belt connection is shown in FIGS. 1 and 2 where first end 11 has the hook portion 13 of the hook and loop fastening material affixed to the inward surface 15 while second end 12 has the loop portion 14 of the hook and loop fastening material affixed to the outward surface 16. Other means to connect the belt ends may also be used, but the hook and loop method is easily adjustable to a wide range of players.

Continuing to refer to FIG. 1, frame 20 is shown centrally located on the outward surface of the belt. Frame 20 is approximately eight inches wide by thirteen inches long and made from one-eighth inch thick plastic material in the preferred embodiment. When worn by the player, frame 20 is located on the player's back side near the waist and extends upward across the small of the player's back. Shown also are multiple pod loops, 30*a*, 30*b*, and 30*c*, each shown with a paintball storage pod 100 inserted. The paintball storage pods may be inserted from wither direction depending on the player's preference. Frame 20 includes at least one guide 26*a* used for connecting the pod loops to the frame in a fashion that allows the pod loops to move vertically relative to the wearer's body. In the preferred embodiment, guide 26*a* is a slot that extends through frame 20 from the interior surface 22 to the exterior surface 24. Two parallel guides 26*a* and 26*b* are used in the preferred embodiment to provide stability for the paintball pod loops. Each guide is approximately three-eighths of an inch wide and extends approximately eleven inches along an axis parallel to the player's back. However, when larger frames are employed, the length of the guides may be increased within the limitations the frame size to accommodate more pod loops. Guides 26*a* and 26*b* are located approximately four inches apart on frame 20.

Tension strap 35 is shown out of its normal position during play for clarity. One end of tension strap 35 is connected to the uppermost pod loop, 30*c* in the Figure. Regardless of the number of pod loops included, one end of tension strap 35 is connected to the pod loop furthest from the base edge 21 of frame 20. The distal end is looped around the group of pods and secured to the lower portion of frame 20 using a removable connection. In the preferred embodiment, tension strap 35 is made from an elastic fabric material and the removable connection is hook and loop material made up of two interfacing members with the first member 36 affixed to tension strap 35 and the second member 37 affixed to the inward surface of frame 20 adjacent to base edge 21. The purpose of tension strap 35 is to apply a downward force to the group of pod loops and the therein contained paintball pods. Elastic fabric materials of the type used herein are typically capable of stretching to an extended length ranging from 120% to 160% of their original, unstretched length. When a paintball pod belt is removed, the pod loop from which it was removed will collapse and the tension strap will pull the remaining pods in a downward direction so that a pod will be located near the lower edge of the frame as long as any pods are contained in the carrier.

FIG. 2 is a view of paintball pod carrier 5 showing the interior surface 22 of frame 20 and the inward surface 15 of belt 10. The remaining details of the belt connection that were partially shown in FIG. 1 are also shown in FIG. 2. First end 11 has the hook portion 13 of the hook and loop fastening material affixed to the inward surface 15 so that the hook and loop material will mesh when the belt ends are brought together thereby securing the belt. Spacers 28*a* and 28*b* are affixed to the interior surface of the frame parallel to guides 26*a* and 26*b*. Spacers 28*a* and 28*b* cause a separation between interior surface 22 and the player's back to allow unrestricted movement of the slide connectors 38 in guides 26*a* and 26*b*. In the preferred embodiment, spacers 28*a* and 28*b* provide separation between interior surface 22 and the wearer's back ranging from one half to one inch. Other equivalent configurations are envisioned to provide the required clearance for slide connector movement.

Figure 3:
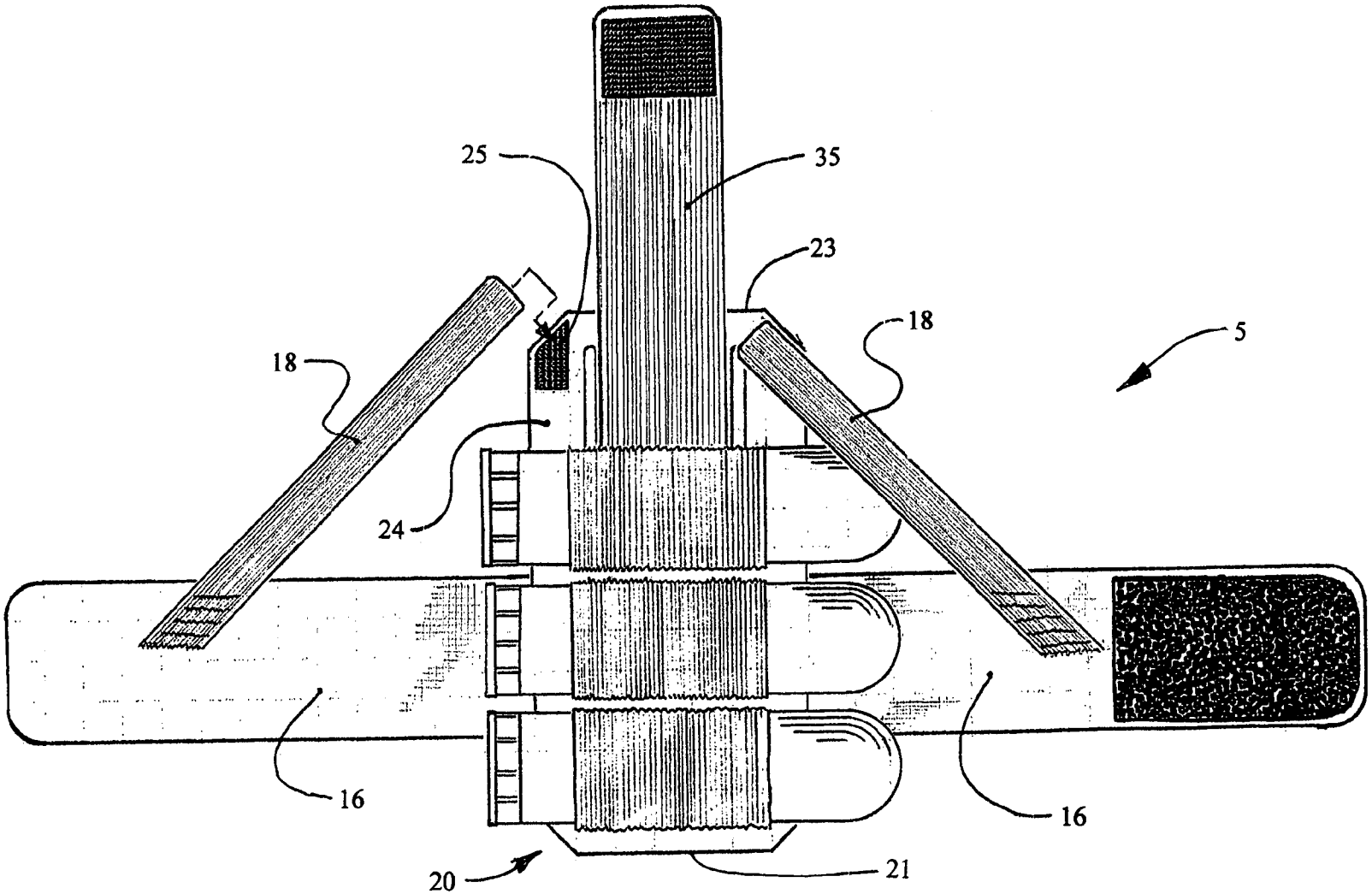
FIG. 3 is an elevation view of the paintball pod carrier using a belt with additional frame stabilizers to attach the carrier to the player's body.

FIG. 3 shows the paintball pod carrier 5 using a belt having additional frame stabilizers 18 to attach the carrier to the player's body. The desired size of the frame 20 may extend beyond the limits that can be restrained in a stable manner by belt 10. The addition of stabilizers 18 prevents frame 20 from twisting about the belt in such a manner that the frame 20 would not remain generally parallel the player's back. In this alternate embodiment, two stabilizers are employed, one on either side of frame 20. One end of stabilizer 18 is affixed to the outward surface 16 of belt 10 adjacent to the player's waist below the arm. The other end of stabilizer 18 includes a means to removably connect the stabilizer to frame 20. The alternate embodiment employs mating portions of hook and loop fastening material with the first portion located on the end of stabilizer 18 and the other located on the exterior surface 24 of frame 20 near the top edge 23. Stabilizers 18 are made from elastic material similar to that used to form the pod loops.

Figure 4:
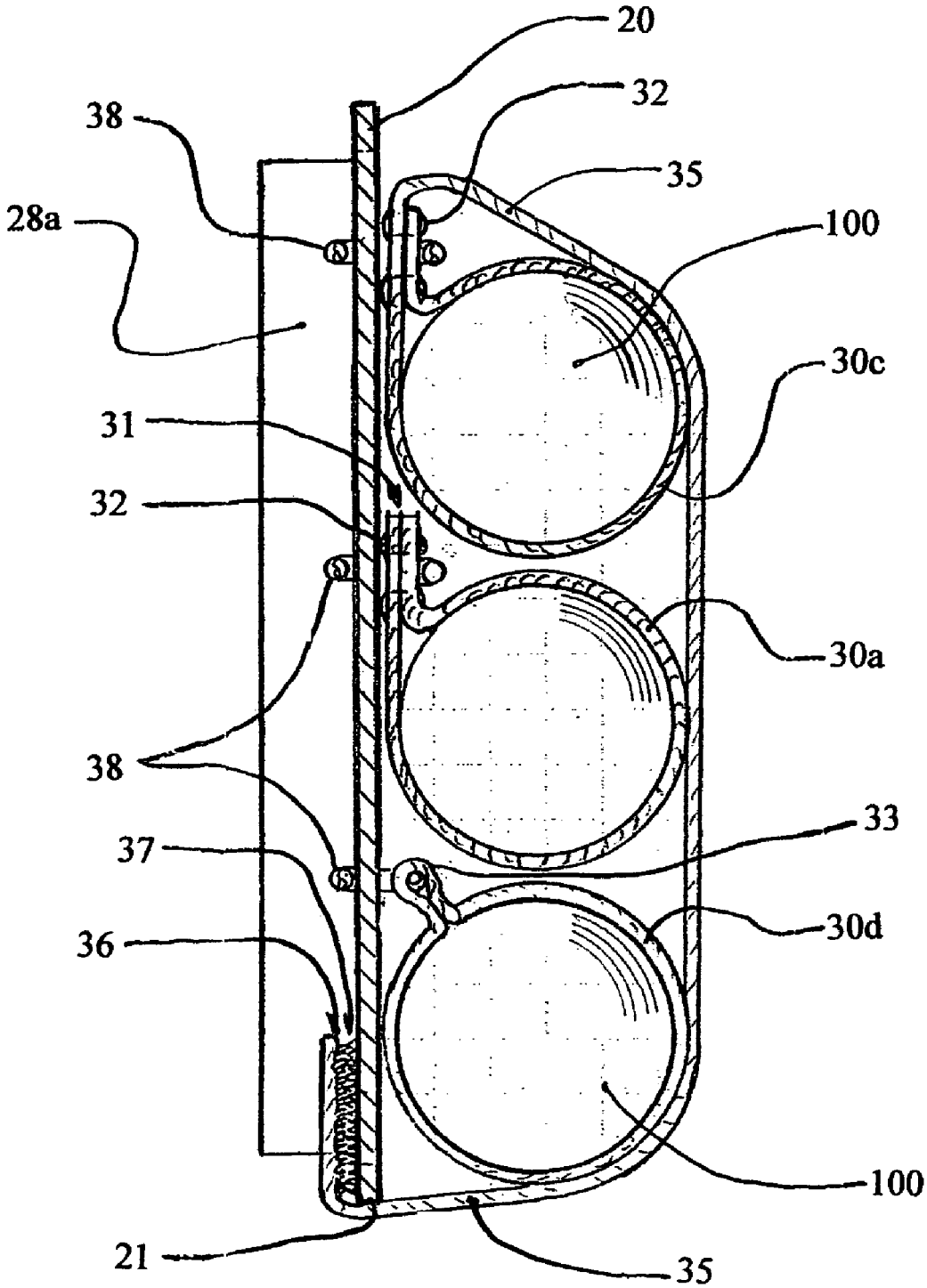
FIG. 4 is a section view of the paintball pod carrier frame that also shows an alternate pod loop.

FIG. 4 is a section view of the paintball pod carrier frame that shows tension strap 35 in its normal play position to cause the pod loops to move toward the base edge of frame 20. One end of tension strap 35 is affixed to the top-most pod loop, item 30*c* in the figure. The distal end of the tension strap is looped around the group of pods and secured to the lower portion of frame 20 using a removable connection. In the preferred embodiment, the removable connection is hook and loop material made up of two interfacing members with the first member 36 affixed to tension strap 35 and the second member 37 affixed to the inward surface of frame 20 adjacent to base edge 21. Tension strap 35 is made from an elastic material that is stretched slightly when surrounding two or more pod so that a downward force is applied to the group of pod loops and the therein contained paintball pods. When a paintball pod belt is removed, the pod loop from which it was removed will collapse and the tension strap will pull the remaining pods in a downward direction so that a pod will be located near the lower edge of the frame as long as any pods are contained in the carrier.

FIG. 4 also shows two variations of pod loops 30. Pod loop 30*a* is formed from a strap made from an elastic fabric material similar to that used in the tension strap with a width of approximately four inches. The loop is formed by binding the ends of the strap together so that cylindrical portion is formed to secure the paintball pod and a that a tab 31 is also formed at one point on the pod loop 30*a*. Pressing grommets 32 through the tab 31 secures the ends of the elastic fabric material and provides openings in the tabs for connecting the pod loop to the frame using slide connectors 38. Grommet 32 placement on the pod loops is aligned with guides 26*a* and 26*b*. The pod loops are connected to frame 20 by slide connectors 38 that extend through grommets 32 and guides 26*a* and 26*b* to hold the pod loops adjacent to the frame while allowing the pod loops to move along the length the guides. The loop portion of the pod loop has an inner circumference slightly smaller than the paintball pod so that the elastic fabric material is slightly elongated when a pod is inserted. In the preferred embodiment, slide connectors 38 extend through grommets 32 and guides 26*a* and 26*b* to hold the pod loops adjacent to the frame while allowing the pod loops to move along the length the guides. The slide connectors can be in the form of a simple loop of string, wire, polymer mono-filament, or other suitable material that extends though both guides and grommets. Individual slide connectors such as a loose-fitting rivet may also be used for each grommet/guide connection.

An alternate pod loop 30*d* may be formed by connecting the ends of the elastic fabric material together to form a cylinder and then connecting two portions of the material together so that two cylinders are formed; the first to contain the paintball pod and a the second, a smaller loop 33, to provide a means to connect slide connector 38 to the pod loop. The preferred slide connector used for this alternate loop is a single loop of string, wire or other similar material that passes through smaller loop 33 and guides 26*a* and 26*b*, and then between the guides adjacent to the interior surface of the frame.

Figure 5:
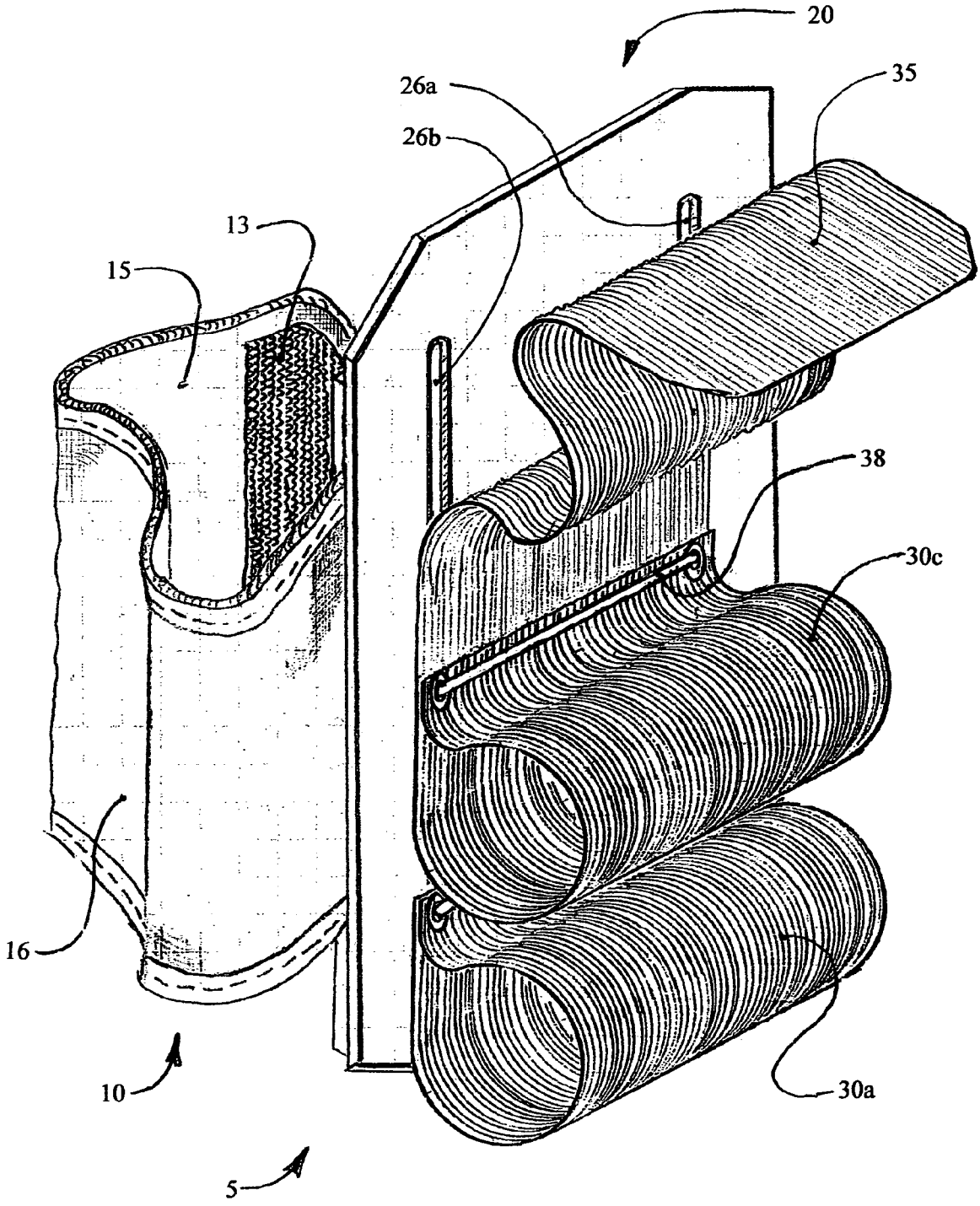
FIG. 5 is a perspective view of the paintball pod carrier showing the belt and frame with two pod loops connected by the slide connectors.

FIG. 5 shows the paintball pod belt having two pod loops from a three-quarter rear perspective view. Frame 20 has the preferred two parallel guides 26*a* and 26*b* oriented vertically with respect to the player's body. While two pod loops, 30*a* and 30*c* are shown, more loops may be added up to the limits of guides 26*a* and 26*b* to suit the demands of play. The preferred embodiment of the invention includes six pod loops to enable the player to carry approximately 900 additional paintballs during a paintball game. The upper-most pod loop, 30*c* in the figure, include tension strap 35. The purpose of tension strap 35 is to apply a downward force to the group of pod loops and the therein contained paintball pods. When the paintball pod belt is being used for paintball game play each available pod loop will contain a paintball pod. The pods are arranged in a parallel fashion horizontally across the player's back. The elastic fabric material from which the pod loops are formed is pliable and will fold flat when a pod is removed so that the next available paintball pod is located in approximately the same location as pod loop 30*a* each time a pod is removed until there are no pods remaining in the carrier.

Figure 6:
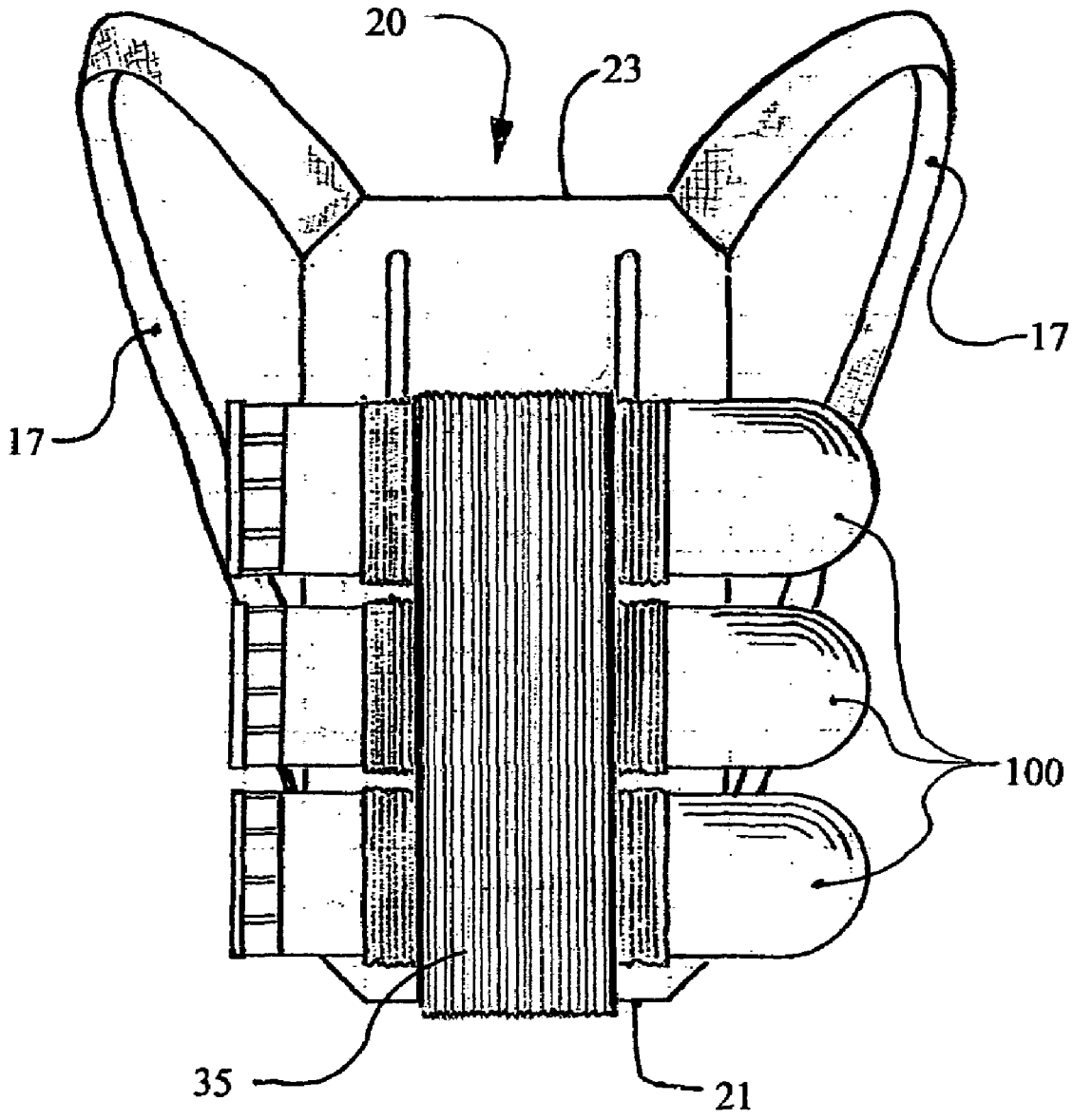
FIG. 6 is an elevation view of the paintball pod carrier using an alternate attachment means to the player's body.

FIG. 6 shows an alternate attachment means for wearing the paintball pod carrier in which the belt 10 is replaced by a pair of shoulder straps 17. Shoulder straps allow the length of frame 20 to be extended beyond that which can be supported by the belt 10 alone or the belt 10 in combination with stabilizer 18, shown in FIG. 3. The additional length between base edge 21 and top edge 23 allows longer guides into which more pod loops may be added. In the preferred embodiment optimized for use with a belt mount, frame 20 is approximately eleven inches long and have up to approximately nine pod loops. The backpack style increases the capacity so that approximately fifteen pods may be carried. It is also envisioned that the shoulder straps and the belt might be combined to provide a more secure connection of the paintball pod carrier frame to the player.

Although the invention has been described in connection with specific examples and embodiments, those skilled in the art will recognize that the present invention is capable of other variations and modifications within the scope of the invention but beyond those described herein. These examples and embodiments are intended as typical of, rather than in any way limiting on, the scope of the present invention as presented in the following claims.

I claim as new and for which a Letters Patent of the United States is desired to be secured is:

1. A paintball supply caddy comprising:

a carrier wearable by a person;

a planar frame having an interior and exterior surface, a base edge, a top edge, and at least one elongate slot in said planar frame oriented perpendicularly to said base edge, said planar frame affixed to said carrier so that interior surface is adjacent to the person's back;

a plurality of loops, each loop defining an opening that receives an object of a predetermined circumference and each having a connecting structure interacting with the said at least one slot in a manner that locates said plurality of loops generally adjacent one another on said exterior surface of said planar frame thereby allowing each loop to move in relation to said planar frame along the length of said slot; and a tensioning apparatus having a fixed end and an attachable end, said fixed end interconnected to a loop most distant from said base edge and said attachment end being selectively connectable to said planar frame adjacent to said base edge, said tensioning apparatus causing said plurality of loops to be drawn toward said base edge as said objects are removed.

2. The paintball supply caddy as described in claim 1 wherein the carrier is a belt.

3. The paintball supply caddy as described in claim 1 wherein the carrier is a pair of shoulder straps.

4. The paintball supply caddy as described in claim 1 wherein the loop is formed of a pliable material.

5. The paintball supply caddy as described in claim 1 wherein the loop is formed of a pliable, elastic material.

6. The paintball supply caddy in claim 1 wherein the tensioning apparatus is formed of a pliable elastic material.

7. The paintball supply caddy in claim 1 wherein the means to connect the attachable end of the tensioning apparatus to the planar frame is by hook and loop fastening material.

* * * * *